US010246909B2

(12) United States Patent
Cousin et al.

(10) Patent No.: US 10,246,909 B2
(45) Date of Patent: Apr. 2, 2019

(54) ELECTRONIC HANDLE FOR A VEHICLE DOOR

(71) Applicant: U-Shin Italia S.p.A., Pianezza (IT)

(72) Inventors: Arnaud Cousin, Creteil (FR); Anthony Guerin, Creteil (FR)

(73) Assignee: U-Shin Italia S.p.A., Pianezza (IT)

( * ) Notice: Subject to any disclaimer, the term of this patent is extended or adjusted under 35 U.S.C. 154(b) by 0 days.

(21) Appl. No.: 15/916,303

(22) Filed: Mar. 9, 2018

(65) Prior Publication Data

US 2018/0195319 A1 Jul. 12, 2018

Related U.S. Application Data

(63) Continuation of application No. PCT/EP2016/071237, filed on Sep. 8, 2016.

(30) Foreign Application Priority Data

Sep. 9, 2015 (EP) ..... 15184532

(51) Int. Cl.
*E05B 81/76* (2014.01)
*E05B 81/90* (2014.01)
(Continued)

(52) U.S. Cl.
CPC ..... *E05B 81/76* (2013.01); *E05B 17/18* (2013.01); *E05B 81/58* (2013.01); *E05B 81/62* (2013.01);
(Continued)

(58) Field of Classification Search
CPC .... Y10T 292/57; Y10S 292/22; Y10S 292/65; E05B 81/76; E05B 81/90; E05B 81/58;
(Continued)

(56) References Cited

U.S. PATENT DOCUMENTS 6,447,030 B1 * 9/2002 Meinke ..... E05B 85/16 292/336.3
2002/0104400 A1 * 8/2002 Hillgaertner ..... E05B 13/005 74/501.6
2007/0001467 A1 * 1/2007 Muller ..... E05B 85/16 292/336.3

FOREIGN PATENT DOCUMENTS

DE 10151870 5/2003
DE 102005049027 4/2007
(Continued)

OTHER PUBLICATIONS

Computer Generated Translation for DE 102007052248, Translation generated on Oct. 4, 2018, https://worldwide.espacenet.com/ (Year: 2018).*

(Continued)

*Primary Examiner* — Alyson M Merlino
(74) *Attorney, Agent, or Firm* — Burris Law, PLLC

(57) ABSTRACT

A handle for a vehicle door is provided. The handle includes a fixed part, a grip lever being moveable according to a grip axis between at least an active position in which the rotation of the grip lever activates the opening of the door, and a rest position in which the grip lever does not rotate, an electronic active position, in which the grip lever activates an electronic unlatching of the door. A blocking element is moveable between a blocking position in which the grip lever is inhibited from rotating from the electronic active position to the mechanical active position and an unblocking position in which the grip lever is free to be moved to the mechanical active position. The present disclosure further relates to a corresponding vehicle that includes the handle.

17 Claims, 2 Drawing Sheets

(51) Int. Cl.

| | |
|---|---|
| ***E05B 85/16*** | (2014.01) |
| ***E05B 17/18*** | (2006.01) |
| ***E05B 81/58*** | (2014.01) |
| ***E05B 81/62*** | (2014.01) |
| *E05B 77/24* | (2014.01) |

(52) U.S. Cl.
CPC ..... *E05B 81/90* (2013.01); *E05B 85/16* (2013.01); *E05B 77/245* (2013.01)

(58) Field of Classification Search
CPC ..... E05B 81/62; E05B 17/18; E05B 17/183; E05B 85/16; E05B 77/245
See application file for complete search history.

(56) References Cited

FOREIGN PATENT DOCUMENTS

| | | |
|---|---|---|
| DE | 102007052248 | 6/2008 |
| DE | 102012103936 | 11/2013 |
| EP | 2072717 | 6/2009 |
| EP | 2620569 | 7/2013 |
| WO | 2007/042233 | 4/2007 |

OTHER PUBLICATIONS

International Search Report for International Application PCT/EP2016/071237, dated Nov. 23, 2016.

* cited by examiner

ELECTRONIC HANDLE FOR A VEHICLE DOOR

CROSS-REFERENCE TO RELATED APPLICATIONS

This application is a continuation of International Application No. PCT/EP2016/071237, filed on Sep. 8, 2016, which claims priority to and the benefit of EP 15184532.8 filed on Sep. 9, 2015. The disclosures of the above applications are incorporated herein by reference.

FIELD

The present disclosure relates to an electronic handle for a vehicle door as well as a vehicle comprising a such electronic handle.

BACKGROUND

The statements in this section merely provide background information related to the present disclosure and may not constitute prior art.

Electronic handles for vehicle doors generally comprise a switch configured to activate a latch mechanism, such as electronic latch, to unlatch the vehicle door.

Some users prefer having electronic handles with a handle grip configured to be actuated by a user according to a reduced length with respect to classical mechanical handles, thereby activating the latch mechanism.

Such electronic handles require a battery to be useable. In case of malfunction of the electronic parts of the handle, the handle is not useable and it is not possible for a user to enter the vehicle.

SUMMARY

The present disclosure provides an electronic handle with a back-up system which is efficient, not costly and easy for the user to activate in case of a malfunction of the handle such as a loss of battery, electric default or defect of a switch.

To this end the present disclosure relates to an electronic handle for a vehicle door, the handle comprising:

- a grip lever being moveable according to a grip axis between a mechanical active position in which the rotation of the grip lever activates the opening of the door, a rest position in which the grip lever is not rotated, and an electronic active position between the rest position and the mechanical active position, in which the grip lever activates the electronic unlatching of the door;
- a fixed part which is fixed relatively to the grip lever, wherein a blocking element is interposed between the fixed part and the grip lever, the blocking element being moveable between a blocking position in which the grip lever is inhibited from rotating from the electronic active position to the mechanical active position and an unblocking position in which the grip lever is free to be moved to the mechanical active position.

Advantageously, the handle of the present disclosure comprises a blocking element enabling the unblocking of the grip lever in case of a malfunction of the handle, specifically of one or several electronic components such as a loss of battery, electric default or defect of a switch. Such a blocking element is easy to use, efficient and not costly in comparison to the prior art.

Indeed, in case of a malfunction of the handle, in particular of the electronic parts, the blocking element may be moved to the unblocking position for enabling the grip lever to move to the mechanical active position so as to open the vehicle door.

The handle of the present disclosure has also the advantage of being usable again after the use of the blocking element, when said malfunction is overcome, for example when the energy is restored in the battery. Indeed, the blocking element may be moved back in the blocking position for the normal use of the handle.

According to further forms of the present disclosure, which can be considered alone or in combination:

- the fixed part comprises a lockset receiver part or a part of the bracket intended to receive the grip lever; and/or
- the handle further comprises a blocking return device, and in one form of the present disclosure, includes at least one compression spring, urging the blocking element against the fixed part and the grip lever; and/or
- the blocking element is a blocking lever having a blocking protuberance intended to cooperate with a stop element of the grip lever, the said blocking element is rotatably mounted according to a blocking axis; and/or
- the rotation axis of the blocking element is mounted on the fixed part; and/or
- the fixed part comprises two protuberances for receiving the rotation axis of the blocking element; and/or
- the grip lever further comprises a stop recess comprising the stop element and configured to receive the blocking protuberance in the blocking position of the blocking element; and/or
- the grip lever comprises a column receiving the stop recess; and/or
- the stop recess is greater than the part of the blocking element intended to be received in the stop recess, and in one form of the present disclosure the stop recess is longer than the effective length of the blocking protuberance; and/or
- the blocking element comprises an actuation protuberance configured to be actuated to move the blocking element from the blocking position to the unblocking position; and/or
- the fixed part comprises a removable cap, configured to cover at least partially the blocking element; and/or
- the cap comprises a cap removal cavity configured for cooperating with a tool, and in one form of the present disclosure a cap key, in order to remove the said removable cap; and/or
- the grip lever has a longitudinal shape and the blocking element has a longitudinal shape according to a central shaft from which the blocking protuberance projects, and the central shaft extends substantially perpendicularly to the grip lever; and/or

- the blocking element comprises a fusible area configured such that a part of the blocking element blocking the grip lever may be separated from the rest of the blocking element when the grip element is moved from the rest position to the activation position under a predetermined force such that the broken blocking element does not block the grip lever from moving from the rest position to the activating position.

The present application further relates to a vehicle comprising an electronic handle of the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms of the present disclosure thereof, given by way of example, reference being made to the accompanying drawings, in which.

Figure 1:
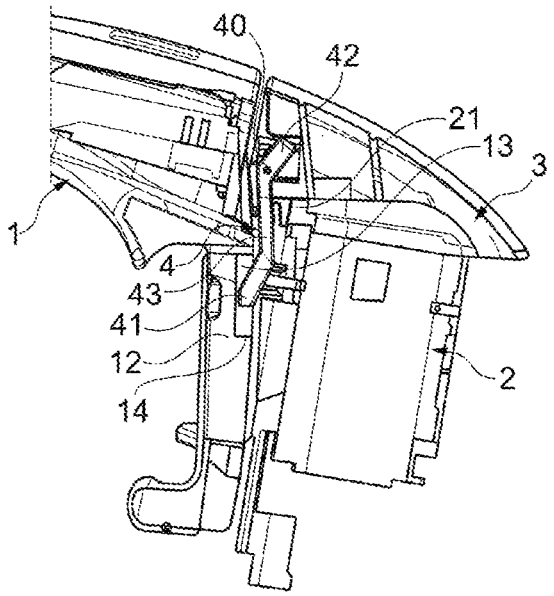
FIG. 1 is a side view of the handle of the present disclosure.

The handle of the present disclosure is adapted to open a vehicle door.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, the handle comprises a grip lever 1 moveable according to a grip axis between a mechanical active position, a rest position and an electronic active position.

In the rest position, the grip lever 1 is not rotated. In particular, in the rest position, the handle is released from any actuation by a user.

The electronic active position is placed between the rest position and the mechanical active position. In the electronic active position, the grip lever 1 activates electronic components, such as at least one switch and triggers, for unlatching electronically the door.

The electronic active position may also correspond to the rest position, namely the electronic components enabling the unlatching of the door are activated by a switch put on the grip lever 1.

In the mechanical active position, a rotation of the grip lever 1 activates the opening of the door.

The mechanical active position is a mechanical opening back-up in case of a malfunction of the handle, specifically at least one of the electronic components, such as a loss of battery, electric default or defect of a switch. In such a case, the grip lever 1 may be moved to the mechanical active position.

In particular, the grip lever 1 then cooperates with an unlatching mechanism such that when the grip lever is rotated towards the mechanical active position, the unlatching mechanism is activated to unlatch the door. A user may then enter or come out of the vehicle. When the grip lever 1 is in the rest position, the unlatching mechanism is not activated and the door may remain closed.

The handle further comprises a fixed part 2, 3 which is fixed relatively to the grip lever 1. According to one form of the present disclosure, the fixed part 2, 3 comprises at least a lock-set receiver part 2, in particular on the driver side, and/or a dummy lock, in particular on a passenger side.

According to a form of the present disclosure, a blocking element 4 is interposed between the fixed part 2, 3 and the grip lever 1. The blocking element 4 is moveable between a blocking position and an unblocking position.

In the blocking position, the grip lever 1 is blocked at the electronic active position so that the grip lever 1 can move from the rest position to the electronic active position but the grip lever 1 is inhibited from reaching the mechanical active position.

In the unblocking position, the grip lever 1 is free to be moved from the rest position to the mechanical active position.

Advantageously, the blocking element 4 may be placed in the blocking position so as to limit the length of actuation of the grip lever 1 to open the vehicle door in the normal electronic use.

In case of malfunction of the handle, in particular of the electronic parts, the blocking element 4 may be moved to the unblocking position such that the normal mechanical unlatching mechanism of the grip lever 1 may be used.

If the malfunction is overcome, for example the batteries are charged again, the blocking element 4 may be moved to the blocking position to restore electronic use of the handle.

The handle further comprises a bracket 6 intended to receive the grip lever 1. In particular, the bracket 6 is a supporting structure placed inside the vehicle door and configured to support internal parts of the handle.

According to another form of the present disclosure, the fixed part comprises a lockset receiver part 2 or a part of the bracket 6 intended to receive the grip lever.

According to one form of the present disclosure, the handle further comprises a blocking return device 21, while yet another form of the present disclosure includes at least one compression spring, urging the blocking element 4 against the bracket 6 and the grip lever 1. In particular, the blocking return device 21 urge the blocking element 4 towards the blocking position.

Advantageously, the blocking return device 21 enable to have an autonomous mechanical returning of the blocking element 4 to the blocking position and maintain the electronic configuration of the handle of the present disclosure.

According to yet another form of the present disclosure, the blocking element 4 is a blocking lever having a blocking protuberance 41 intended to cooperate with a stop element 14 of the grip lever 1. The blocking element 4 is rotatable mounted according to a blocking axis 40. A lever form is simple to insert between the grip lever 1 and the fixed part 2, 3 such that an extremity of the lever blocks the grip handle and another extremity is accessible to the user.

Alternatively, a blocking lever mounted in translation could also be used.

According to a form of the present disclosure, the rotation axis 40 of the blocking element 4 is mounted on the fixed part 2, 3. In such a form, the blocking element 4 is maintained on the fixed part 2, 3 and is less subject to environmental stress such as moisture and dust.

Alternatively, the rotation axis could also be on the grip lever 1. In such an aspect of the present disclosure, the blocking element 4 is maintained on the bracket grip lever 1 and comes out of the door with the grip lever 1 moving to the activation position.

According to another form of the present disclosure, the fixed part 2, 3 comprises two protuberances 61, 62 for receiving the rotation axis 40 of the blocking element 4.

In another form of the present disclosure, the grip lever 1 further comprises a stop recess 13 comprising the stop element 14 and configured to receive the blocking protuberance 41 in the blocking position of the blocking element 4.

According to yet another form of the present disclosure, the grip lever 1 comprises a column 12 receiving the stop recess 13 or the stop element 14. Advantageously, in such a form, the stop recess 13 or the stop element 14 and the corresponding part of the blocking element 4 are placed deeper in the door so as to be less subject to environmental stress such as moisture and dust.

In other forms of the present disclosure, the stop recess 13 is greater than the part of the blocking element 4 intended to be received in the stop recess 13, and in one form is longer that the effective length of the blocking protuberance 41. More generally, there is a given distance between the cooperating parts of the blocking element 4 and the stop element 14. Advantageously, such a form defines a given distance corresponding to the reduced length of actuation of the grip lever 1 for an electronic handle.

According to variations of the present disclosure, the blocking element 4 comprises an actuation protuberance 42 configured to be actuated to move the blocking element 4 from the blocking position to the unblocking position.

Figure 2:
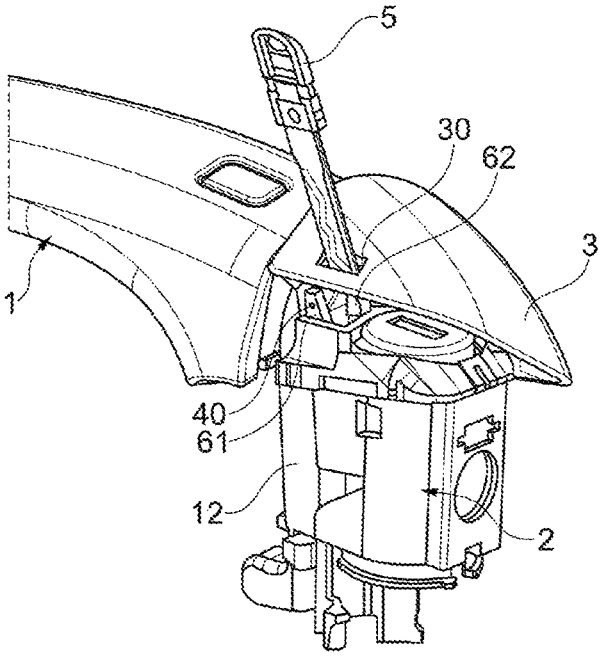
FIG. 2 is a perspective view of the handle of the present disclosure showing a cap removed by an opening tool.

In another form of the present disclosure, the fixed part 2, 3 comprises a removable cap 3, configured to cover at least partially the blocking element 4. In particular, the cap 3 covers the actuation protuberance 42 as shown in FIG. 2. In particular, a releasable cap securing mechanism is provided on the cap 3 and/or on the fixed part 2 and/or on the grip lever 1 in this regard. The removable cap enables to removably hide the fixed part 2 and a part of the blocking element 4, in particular the blocking protuberance 42.

According to yet another form, the cap 3 comprises a cap removal cavity 30 a configured for cooperating with a tool, and in one form a cap key 5, in order to remove the said removable cap. In such a form, the cap 5 is releasably secured on the handle.

Alternatively, the cap 3 could be removable manually or with an electronic device such as a remote control.

In one form of the present disclosure, the grip lever 1 has a longitudinal shape and the blocking element 4 has a longitudinal shape according to the longitudinal axis of a central shaft 43 from which the blocking protuberance 41 projects. The central shaft 43 extends along the said longitudinal axis and substantially perpendicularly to the grip lever 1. More particularly, the central shaft 43 extends substantially parallel to the column 12.

Such an arrangement enables to provide an inclined blocking projection 41 configured to be pushed by the column 12 when the grip lever 1 comes back to the rest position. In addition, the blocking resistance of the blocking element 4 is based on the length of the central shaft such that the blocking element 4 can be provided as a thin lever.

According to one form of the present disclosure, the blocking element 4 comprises fusible area 44 configured such that a part of the blocking element 4 blocking the grip lever 1 may be separated from the rest of the blocking element 4 when the grip element 1 is moved from the rest position to the activation position under a predetermined force such that the broken blocking element 4 does not block the grip lever 1 from moving from the rest position to the activating position. Advantageously, in an emergency situation, the grip lever 1 may be pulled so as to break the blocking element 4 and have access to the vehicle.

Figure 5:
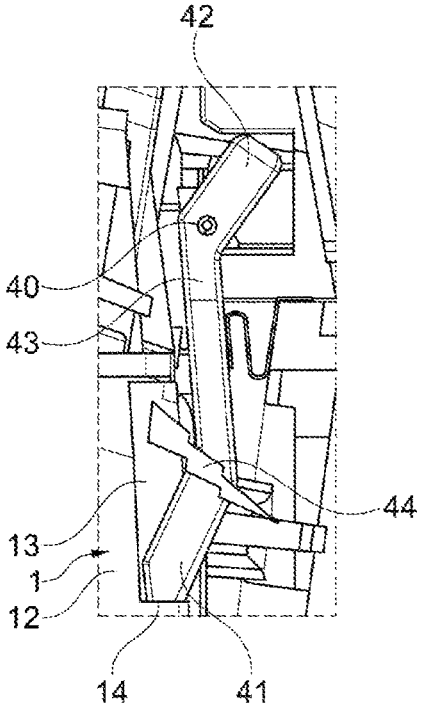
FIG. 5 is a close view of the blocking element showing the fusible area.
Figure 3:
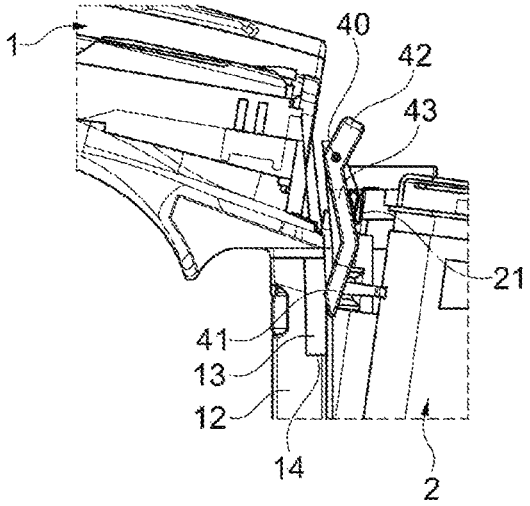
FIG. 3 is a side view according to FIG. 1 in which the cap is removed and the blocking element is in the unblocking position.
Figure 4:
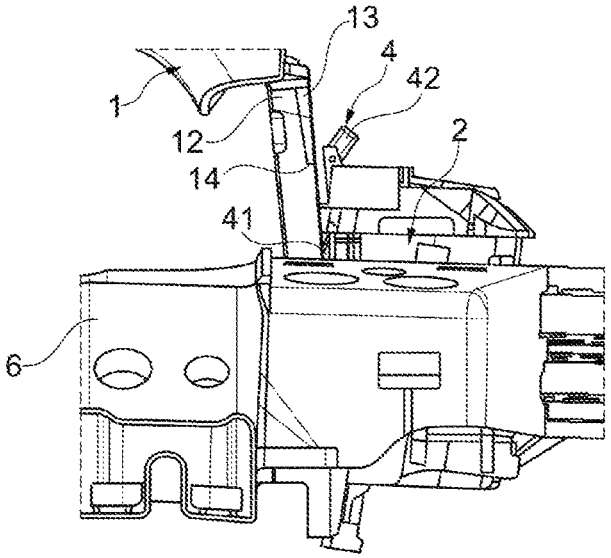
FIG. 4 is a side view according to FIG. 3 in which the grip lever is moved towards the active position.

More particularly, a projecting blocking projection 41 makes it easy to make a fusible area at the beginning of the projection as shown in FIG. 5.

The present disclosure has been described above with the aid of variations without limitation of the general inventive concept as defined in the claims.

Many modifications and variations will suggest themselves to those skilled in the art upon making reference to the foregoing illustrative examples, which are given by way of example only and which are not intended to limit the scope of the present disclosure, that being determined solely by the appended claims.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An electronic handle for a vehicle door, the electronic handle comprising:

a grip lever being rotatable according to a grip axis between a mechanical active position in which rotation of the grip lever mechanically unlatches the door, a rest position in which the grip lever is not rotated, and an electronic active position between the rest position and the mechanical active position, in which rotation of the grip lever activates electronic unlatching of the door; and a fixed part which is fixed relative to the grip lever, wherein a blocking element is interposed between the fixed part and the grip lever, the blocking element being moveable between a blocking position in which the grip lever is inhibited from being rotated from the electronic active position to the mechanical active position, and an unblocking position in which the grip lever is free to be rotated to the mechanical active position.

2. The electronic handle according to claim 1, wherein the fixed part comprises a lockset receiver part or a part of a bracket intended to receive the grip lever.

3. The electronic handle according to claim 1, further comprising a blocking return device configured to urge the blocking element against the fixed part and the grip lever.

4. The electronic handle according to claim 3, wherein the blocking return device is a compression spring.

5. The electronic handle according to claim 1, wherein the blocking element is a blocking lever having a blocking protuberance configured to cooperate with a stop element of the grip lever, the said blocking element being rotatably mounted according to a blocking axis.

6. The electronic handle according to claim 5, wherein the blocking axis of the blocking element is mounted on the fixed part.

7. The electronic handle according to claim 5, wherein the fixed part comprises two protuberances for receiving the blocking axis of the blocking element.

8. The electronic handle according to claim 5, wherein the grip lever further comprises a stop recess comprising the stop element and is configured to receive the blocking protuberance in the blocking position of the blocking element.

9. The electronic handle according to claim 8, wherein the grip lever comprises a column including the stop recess.

10. The electronic handle according to claim 8, wherein the stop recess is longer than a part of the blocking element.

11. The electronic handle according to claim 1, wherein the blocking element comprises an actuation protuberance configured to be actuated to move the blocking element from the blocking position to the unblocking position.

12. The electronic handle according to claim 1, wherein the fixed part comprises a removable cap configured to cover at least partially the blocking element.

13. The electronic handle according to claim 12, wherein the cap comprises a cap removal cavity configured for cooperating with a tool to remove said removable cap.

14. The electronic handle according to claim 13, wherein the tool is a cap key.

15. The electronic handle according to claim 5, wherein the grip lever has a longitudinal shape and the blocking element has a longitudinal shape according to a central shaft from which the blocking protuberance projects, and wherein the central shaft extends substantially perpendicularly to the grip lever.

16. The electronic handle according to claim 1, wherein the blocking element comprises a fusible area configured such that a part of the blocking element inhibiting rotation of the grip lever may be separated from a remainder of the blocking element when the grip lever is rotated from the rest position to the electronic active position under a predetermined force such that the blocking element in a broken state does not inhibit the grip lever from being rotated from the rest position to the mechanical active position.

17. A vehicle comprising the electronic handle according to claim 1.

* * * * *